US010709299B2

(12) United States Patent
Wei

(10) Patent No.: US 10,709,299 B2
(45) Date of Patent: Jul. 14, 2020

(54) SHOWER DOOR FRAME AND SHOWER DOOR

(71) Applicant: Ideal Sanitary Ware Co., Ltd., Foshan (CN)

(72) Inventor: Wuxiang Wei, Foshan (CN)

(73) Assignee: Ideal Sanitary Ware Co., Ltd. (CN)

( * ) Notice: Subject to any disclaimer, the term of this patent is extended or adjusted under 35 U.S.C. 154(b) by 30 days.

(21) Appl. No.: 15/764,720

(22) PCT Filed: Jun. 26, 2017

(86) PCT No.: PCT/CN2017/089950
§ 371 (c)(1),
(2) Date: Mar. 29, 2018

(87) PCT Pub. No.: WO2018/214221
PCT Pub. Date: Nov. 29, 2018

(65) Prior Publication Data

US 2019/0038086 A1 Feb. 7, 2019

(30) Foreign Application Priority Data

May 24, 2017 (CN) ..... 2017 1 0374817

(51) Int. Cl.
*A47K 3/36* (2006.01)
*E05D 15/06* (2006.01)
*E06B 3/46* (2006.01)

(52) U.S. Cl.
CPC ..... *A47K 3/362* (2013.01); *E05D 15/0621* (2013.01); *E06B 3/4681* (2013.01); *E05Y 2900/114* (2013.01)

(58) Field of Classification Search
CPC ..... A47K 3/362
(Continued)

(56) References Cited

U.S. PATENT DOCUMENTS

2014/0237903 A1 8/2014 Wei
2014/0250584 A1* 9/2014 Wei ..... A47K 3/30 4/607

FOREIGN PATENT DOCUMENTS

CN 202044176 U 11/2011
CN 203175308 U 9/2013
(Continued)

OTHER PUBLICATIONS

International Search Report from PCT/CN2017/089950, dated Dec. 13, 2017, 6 pages.

*Primary Examiner* — Lauren A Crane
(74) *Attorney, Agent, or Firm* — Lerner, David, Littenberg, Krumholz & Mentlik, LLP

(57) ABSTRACT

A shower door frame is disclosed comprising a track and a side frame; wherein a fixing part is fixed at a tail end of the track, a positioning block is arranged on an outer side of the fixing part, and a retaining block is arranged at a top end of the positioning block; the positioning block is embedded into the side frame; a locking assembly is arranged on the side frame, the locking assembly comprises a base fixed on the side frame and a tensioning part hinged with the base, the tensioning part is provided with a locking groove, and the locking groove is buckled with the retaining block. The present invention also provides a shower door comprising the shower door frame. The shower door frame and the shower door are simple in assembly operation, and suitable for a field assembly occasion.

14 Claims, 8 Drawing Sheets

(58) Field of Classification Search
USPC ..... 4/607
See application file for complete search history.

(56) References Cited

FOREIGN PATENT DOCUMENTS

| | | | | |
|---|---|---|---|---|
| CN | 104641064 | A | 5/2015 | |
| EP | 2774519 | A1 * | 9/2014 | ..... A47K 3/30 |
| EP | 2774519 | A1 | 9/2014 | |
| EP | 3061899 | A1 | 8/2016 | |
| GB | 1474081 | A | 5/1977 | |

* cited by examiner

SHOWER DOOR FRAME AND SHOWER DOOR

CROSS REFERENCE TO RELATED APPLICATIONS

The present application is a national phase entry under 35 U.S.C. § 371 of International Application No. PCT/CN2017/089950 filed on Jun. 26, 2017, which claims priority from Chinese Patent Application No. 201710374817.9 filed on May 24, 2017, all of which are hereby incorporated herein by reference.

FIELD OF THE INVENTION

The present invention relates to the field of sanitary utensils, and particularly, to a shower door frame and a shower door using the shower door frame.

BACKGROUND OF THE INVENTION

These days, people often have shower rooms fitted in their bathrooms during decoration, and shower doors are generally required to be installed in bathrooms to separate shower rooms therefrom. Existing shower rooms are generally provided with shower doors having glass plates. Shower doors may be classified into hinged shower doors, push-pull shower doors and the like based on opening-closing manners.

A hinged shower door has a frame provided with glass plates therein. Normally, at least one of the glass plates is a fixed glass plate fixed into the frame, and the fixed glass plate is not movable relative to the frame. Besides, the frame is further provided with at least one movable glass plate therein that is rotationally movable relative to the fixed glass plate, and the movable glass plate is connected with the fixed glass plate by two or more hinges. When a shower door needs to be opened or closed, the movable glass plate may simply be pushed open so that the movable glass plate rotates around axes of the hinges.

A push-pull shower door has a frame comprising one or two tracks, wherein the tracks are provided at the top end or bottom end of the shower door, and arranged basically horizontally relative to the ground. Moreover, side frames are provided on two sides of the frame, which are arranged perpendicularly to the tracks and in fixed connection with the tracks. The frame is provided therein with at least two glass plates. As for the multiple glass plates, they may all be movable glass plates that can slide back and forth within the tracks, or at least one of them is a fixed glass plate that can't slide relative to the tracks. Compared with the hinged shower door, the push-pull shower door has advantages such as space savings.

In these days, many shower doors are custom-made based on customers' requirements. Moreover, the shower doors are often large in sizes, which often require field assembly in customer's bathrooms. During assembly of a push-pull shower door, a plurality of side frames and a plurality of tracks need to be coupled to form a shower door frame. A prior method for assembling a shower door frame is generally as follows: a plurality of holes are drilled in side frames, and a plurality of threaded holes are arranged onto tracks; then, screws are configured to pass through the holes in the side frames and screwed into the threaded holes in the tracks, thereby achieving the fixed coupling of the tracks with the side frames.

However, the prior method for installing shower door frames is relatively time-consuming. Moreover, screws often slip or fracture, which leads to wastage of both manpower and material resources, thus posing uncertain difficulties to the installation of shower doors.

SUMMARY OF THE INVENTION

In order to solve the above problems, it is a major object of the present invention to provide a shower door frame featured by simple installation operation.

It is another object of the present invention to provide a push-pull shower door featured by simple installation operation and saving of installation time.

In order to achieve the major object mentioned above, the present invention provides a shower door frame comprising a track extending in a horizontal direction and a side frame arranged perpendicularly to the track; here, a fixing part is fixed at a tail end of the track, a positioning block is arranged on an outer side of the fixing part, a retaining block is arranged at a top end of the positioning block, and the positioning block is embedded into the side frame; a locking assembly is arranged on the side frame, the locking assembly comprises a base fixed on the side frame and a tensioning part hinged with the base, the tensioning part is provided with a locking groove, and the locking groove is buckled with the retaining block.

One preferred technical solution is that the track is provided thereon with a groove, and a fixing buckle is fixed into the groove; a stopping shoulder is arranged at a tail end of the tensioning part, and extends into the fixing buckle.

A further technical solution is that the fixing buckle comprises a bottom plate fixed into the groove; the bottom plate is provided thereon with a stopping plate, the stopping plate is provided therein with a stopping hole, and the stopping shoulder extends into the stopping hole; a top plate is arranged on a side at a top end of the stopping plate away from the side frame, and the top plate is provided therein with a top hole.

A still further technical solution is that the tensioning part comprises a hinged block and an extension block connected with the hinged block, a locking block is arranged in the middle of the extension block, and the stopping shoulder is arranged at the tail end of the extension block; the locking groove is formed between the hinged block and the locking block.

A still further technical solution is that the side frame is provided with a positioning groove extending in a direction along a length of the side frame, the positioning groove is provided therein with an inserting block, and an inserting hole is arranged into the inserting block; the positioning block is embedded into the positioning groove; a plug portion is arranged at a bottom end of the positioning block, and the plug portion passes through the inserting hole.

A still further technical solution is that the base is fixed on an outer side of the positioning groove, and provided thereon with a hinged groove, and the hinged groove is hinged with the tensioning part via a pin; an opening is arranged at a location on the positioning groove corresponding to the hinged groove; and the tensioning part passes through the opening.

A still further technical solution is that the fixing part comprises a fixing block; the track comprises a cavity having the same cross-sectional shape as the fixing block; and the fixing block is fixed into the cavity.

A still further technical solution is that the fixing block is provided therein with a first threaded hole, the track is provided therein with a first mounting through-hole, and a first threaded fastener passes through the first mounting through-hole and screws into the first threaded hole.

A still further technical solution is that the first mounting through-hole is located at the bottom end of the groove; the bottom plate of the fixing buckle is provided therein with a second mounting through-hole, and the first threaded fastener passes through the second mounting through-hole and the first mounting through-hole and screws into the first threaded hole.

A still further technical solution is that the side frame is provided therein with at least a third mounting through-hole, and a second threaded fastener passes through the third mounting through-hole to be connected with the base.

A still further technical solution is that the positioning block is a positioning boss.

In order to achieve the other object mentioned above, the shower door provided by the present invention comprises a track extending in a horizontal direction and a side frame arranged perpendicularly to the track, and a door plate is equipped in the side frame; here, a fixing part is fixed at a tail end of the track, a positioning block is arranged on an outer side of the fixing part, a retaining block is arranged at a top end of the positioning block, and the positioning block is embedded into the side frame; a locking assembly is arranged on the side frame, the locking assembly comprises a base fixed on the side frame and a tensioning part hinged with the base, the tensioning part is provided with a locking groove, and the locking groove is buckled with the retaining block.

The present invention has the following beneficial effects:

In the shower door frame provided by the present invention, the track is in cooperation with the side frame via the positioning block and the locking assembly. When the shower door frame is installed, the base of the locking assembly is first fixed on the side frame; then, the base is hinged with the tensioning part, and the fixing part is fixed at the end portion of the track; thereafter, the positioning block is embedded into the side frame, and the tensioning part is buckled with the retaining block of the fixing part; after that, the locking groove of the tensioning part cooperates with the retaining block to prevent the fixing part from moving, thus fixing the side frame to the track. It can be seen that when the frame of the shower door is assembled, no screws are required to fix the track on the side frame. Consequently, the installation operation of the shower door frame is very simple, and takes less time. Moreover, the physical demands on installers are low, thereby achieving the rapid and easy assembly of the shower door frame.

Furthermore, the stopping shoulder at the tail end of the tensioning part is configured to extend into the stopping hole of the fixing buckle, which helps prevent the tensioning part from being loosened, thus ensuring stable installation. The extension block of the tensioning part makes it convenient for an installer to hold the tensioning part in hand, and drives the tensioning part to move so as to buckle its latching portion with the plug portion in a rapid and simple manner. As the plug portion is arranged at the bottom end of the positioning block of the fixing part, and the positioning groove is provided therein with the inserting hole, the relative movement between the side frame and the fixing part can be further prevented when the plug portion passes through the inserting hole. The top plate of the fixing buckle is provided therein with the top hole. With the use of other tools, the baffle plate of the fixing buckle may be moved, such that the stopping shoulder is separated from the fixing buckle, thereby facilitating the disassembly of the shower door frame.

The present invention will be described below in greater detail in conjunction with the accompanying drawings and the embodiments.

DETAILED DESCRIPTION OF THE INVENTION

Shower Door Embodiment

Figure 1:
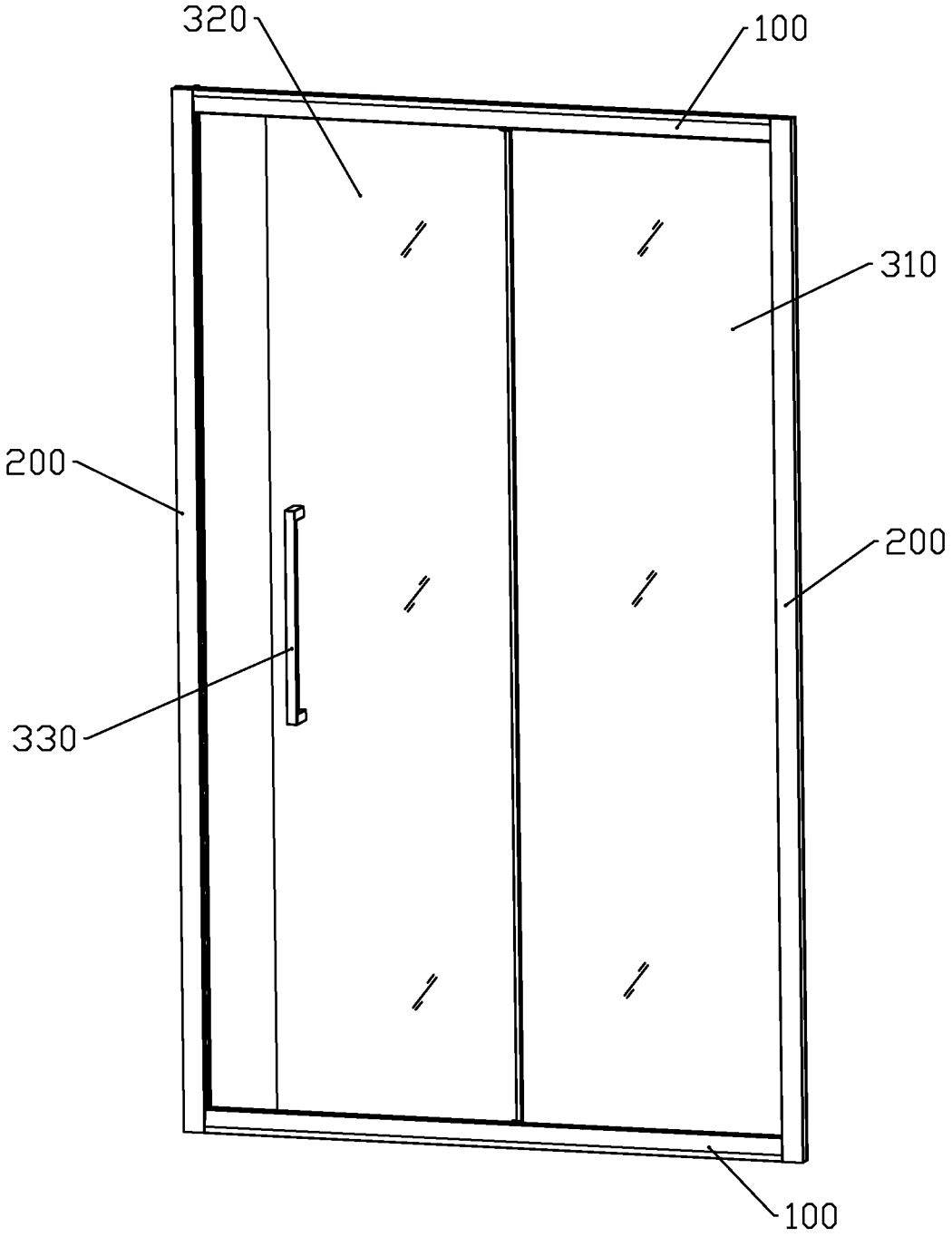
FIG. 1 is a structural view illustrating a shower door embodiment of the present invention after installation in a shower room.

Referring to FIG. 1, the shower door of the present embodiment is a push-pull shower door, which comprises a frame made of metal and glass door plates installed into the frame. The frame comprises two tracks 100, wherein the two tracks 100 are provided respectively at a top end and a bottom end of the shower door, and arranged horizontally relative to the ground. Side frames 200 are arranged between the two tracks 100, wherein the two side frames 200 are located respectively on the left and right sides of the shower door and arranged perpendicularly to the tracks 100. The frame is provided therein with two glass door plates, and in the present embodiment, the two glass door plates are composed of a fixed glass plate 310 that can't slide within the tracks 100, and a movable glass plate 320 that can slide back and forth within the tracks 100. The movable glass plate 320 is provided thereon with a handle 330 for pushing and pulling the movable glass plate 320 to slide back and forth, thereby achieving the opening and closing of the shower door.

Figure 2:
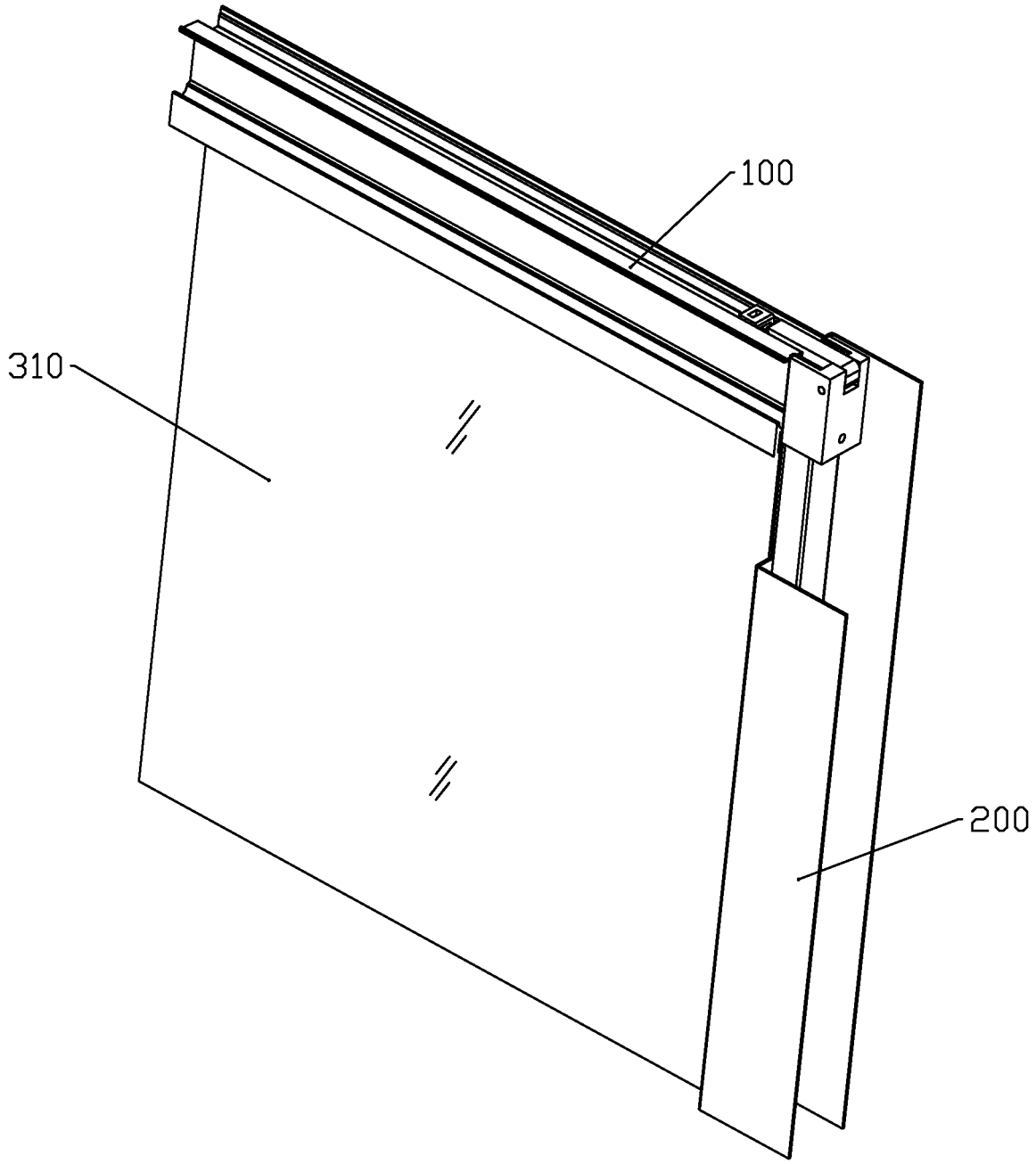
FIG. 2 is an enlarged structural view illustrating the shower door embodiment of the present invention.

Referring to FIG. 2, the tracks 100 and the side frames 200 are coupled together via coupling assemblies to form a shower door frame. The shower door frame has the shower door frame structure as described by the following embodiment.

Shower Door Frame Embodiment

A shower door frame comprises tracks 100, side frames 200 and coupling assemblies at four corners formed by them. The detailed description is made below with a side frame 200 on one side of the fixed glass plate 310, an upper track 100 and coupling assemblies thereof taken as the example.

Figure 3:
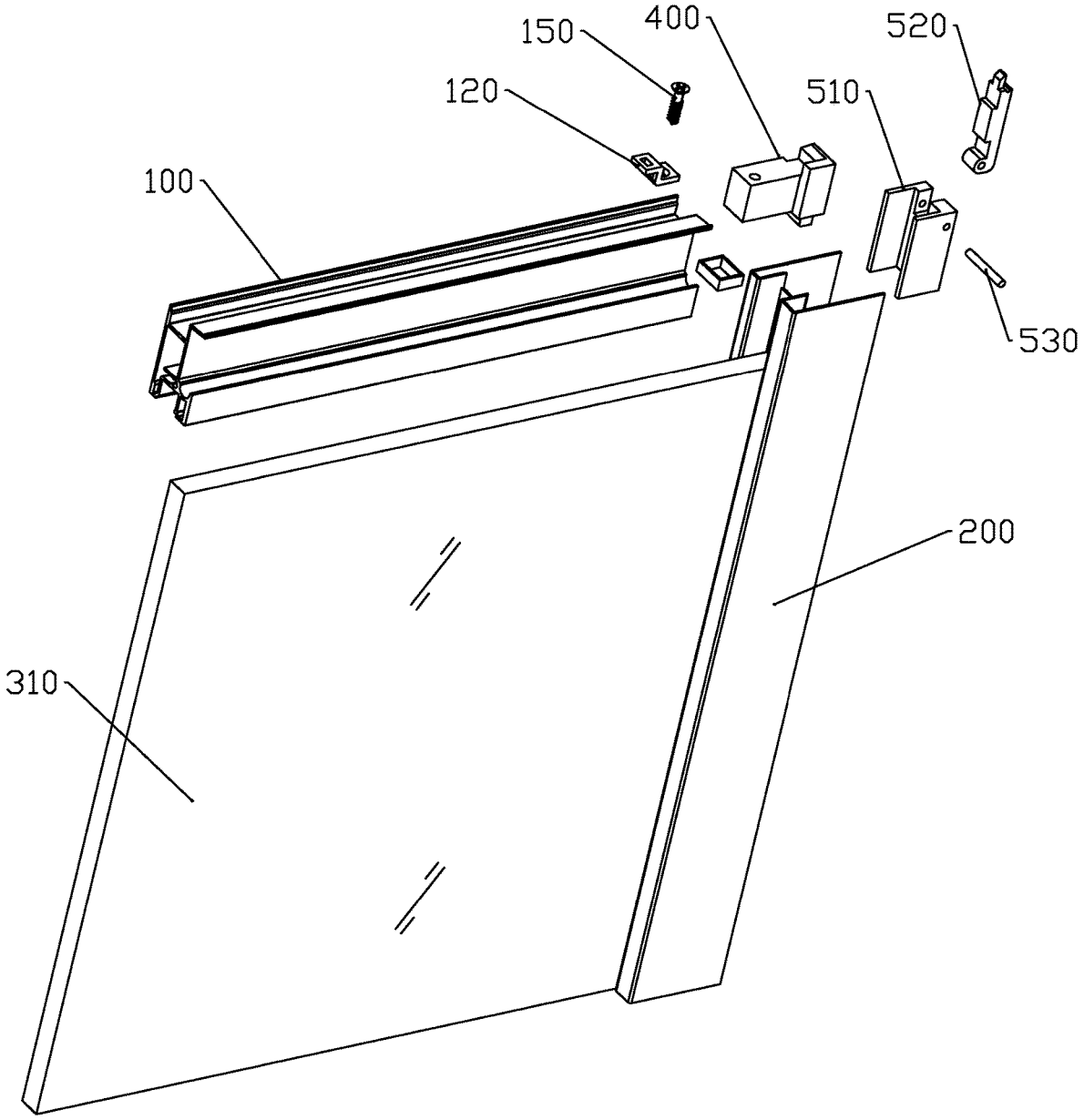
FIG. 3 is an exploded structural view illustrating a shower door frame embodiment of the present invention.
Figure 6:
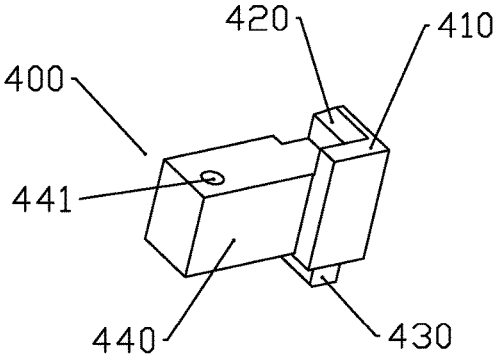
FIG. 6 is an enlarged structural view illustrating a fixing part in the shower door frame embodiment of the present invention.

Referring to FIG. 3, the shower door frame of the present embodiment comprises a track 100 extending in a horizontal direction and a side frame 200 arranged perpendicularly to the track 100. A fixing part 400 is fixed at the tail end of the track 100. Referring to FIG. 6, a positioning block 410 is arranged on the outer side of the fixing part 400, and a retaining block 420 is arranged at the top end of the positioning block 410.

Figure 11:
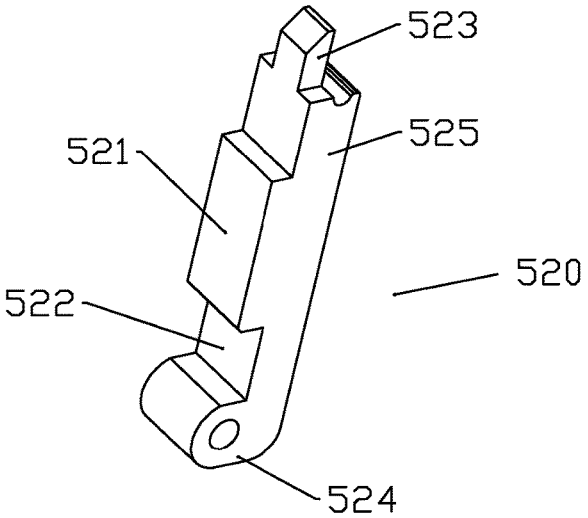
FIG. 11 is an enlarged structural view illustrating a tensioning part in the shower door frame embodiment of the present invention.
Figure 12:
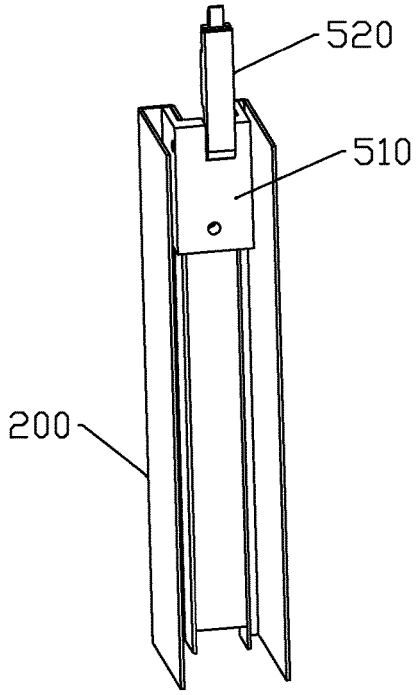
FIG. 12 is an enlarged structural view illustrating a locking assembly installed in the side frame in the shower door frame embodiment of the present invention.
Figure 13:
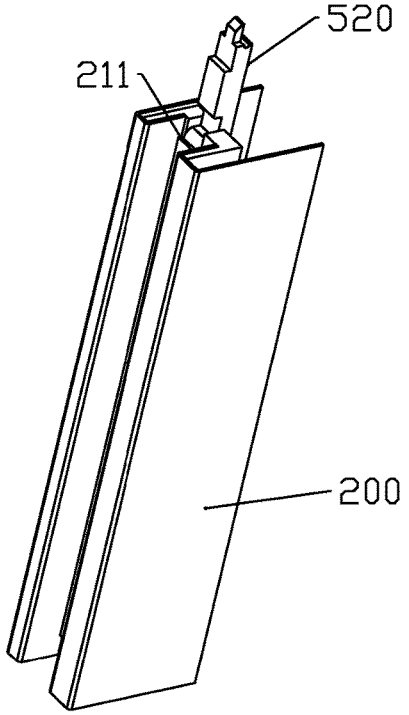
FIG. 13 is an enlarged structural view illustrating, from another viewing angle, the locking assembly installed in the side frame in the shower door frame embodiment of the present invention.
Figure 14:
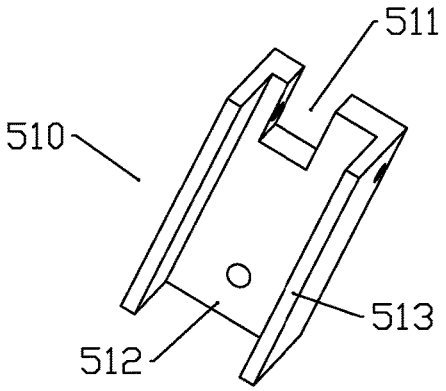
FIG. 14 is an enlarged structural view illustrating a base in the shower door frame embodiment of the present invention.
Figure 15:
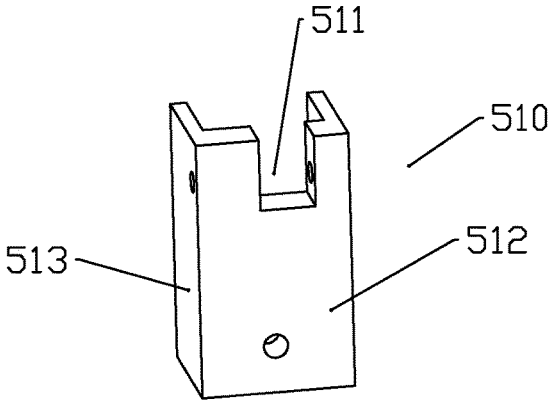
FIG. 15 is an enlarged structural view illustrating, from another viewing angle, the base in the shower door frame embodiment of the present invention.

A locking assembly is arranged on the side frame 200, which comprises a base 510 fixed on the side frame 200 and a tensioning part 520 hinged with the base 510. Referring to FIG. 11, the tensioning part 520 is provided with a locking block 521, and a locking groove 522 is formed on one side of the locking block 521 facing towards the hinged position.

Figure 16:
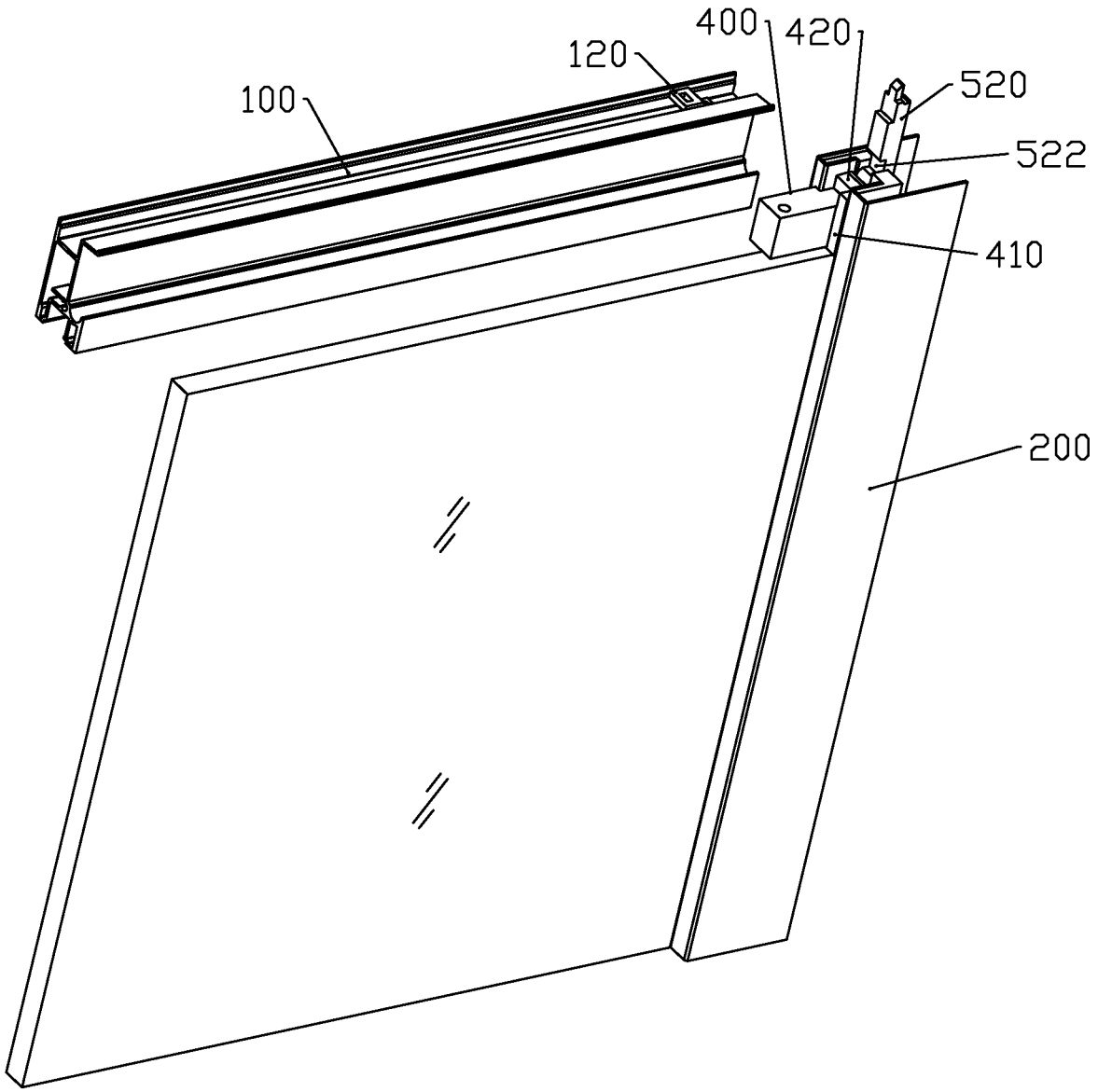
FIG. 16 is an exploded structural view illustrating the shower door frame embodiment of the present invention after installation.
Figure 17:
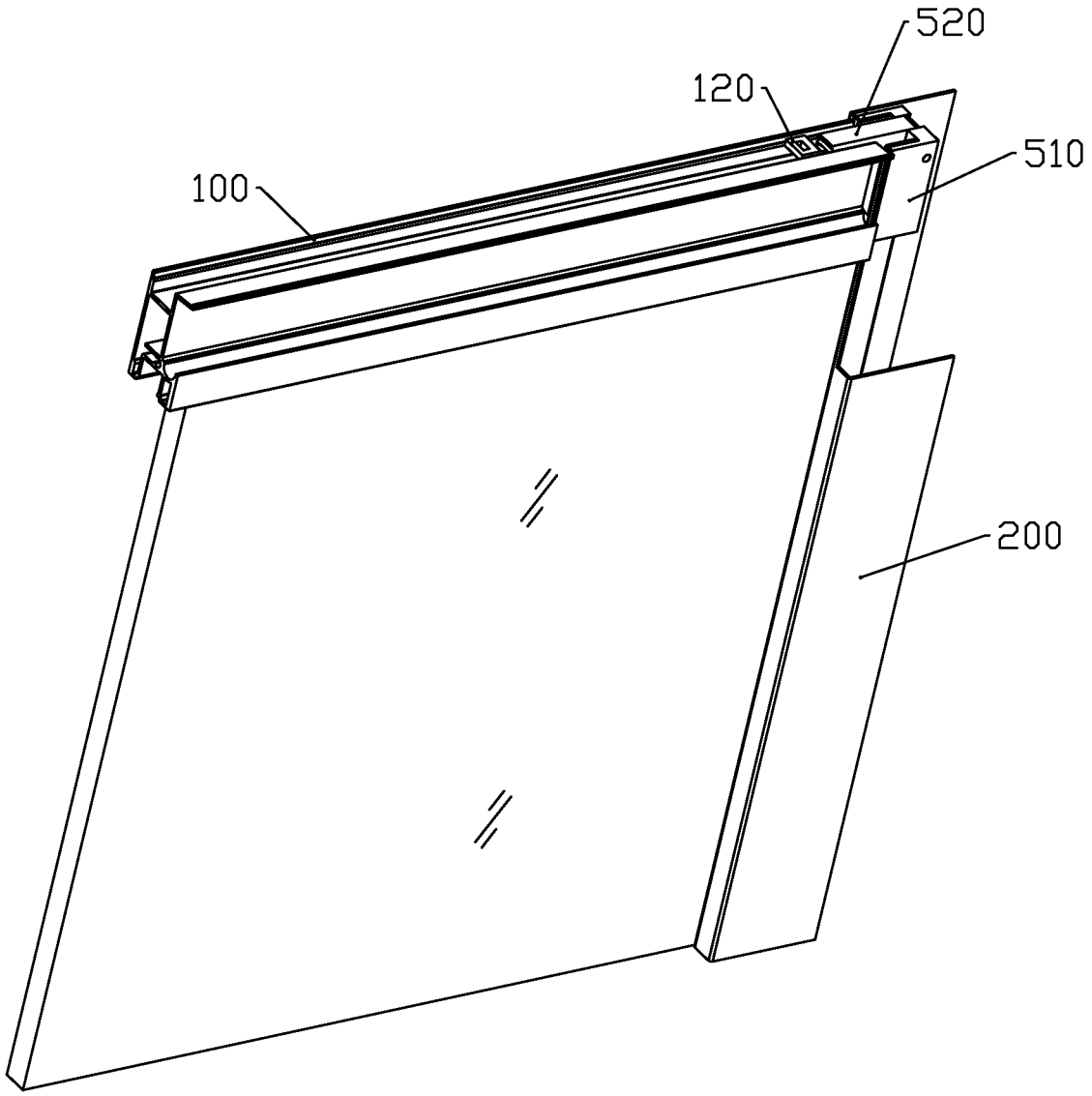
FIG. 17 is a structural view illustrating the shower door frame embodiment of the present invention after installation.

Referring to FIGS. 16-17, the positioning block 410 is embedded into the side frame 200, and the locking groove 522 is buckled with the retaining block 420.

Figure 7:
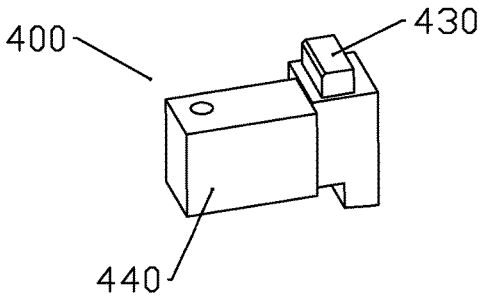
FIG. 7 is an enlarged structural view illustrating, from another viewing angle, the fixing part in the shower door frame embodiment of the present invention.

Referring to FIGS. 6 and 7, a plug portion 430 is arranged at the bottom end of the fixing part 400. The fixing part 400 also comprises a fixing block 440 connected with the positioning block 410. The positioning block 410 is a positioning boss, and the positioning block 410 projects toward one side relative to the fixing block 440 so as to form a boss.

Figure 4:
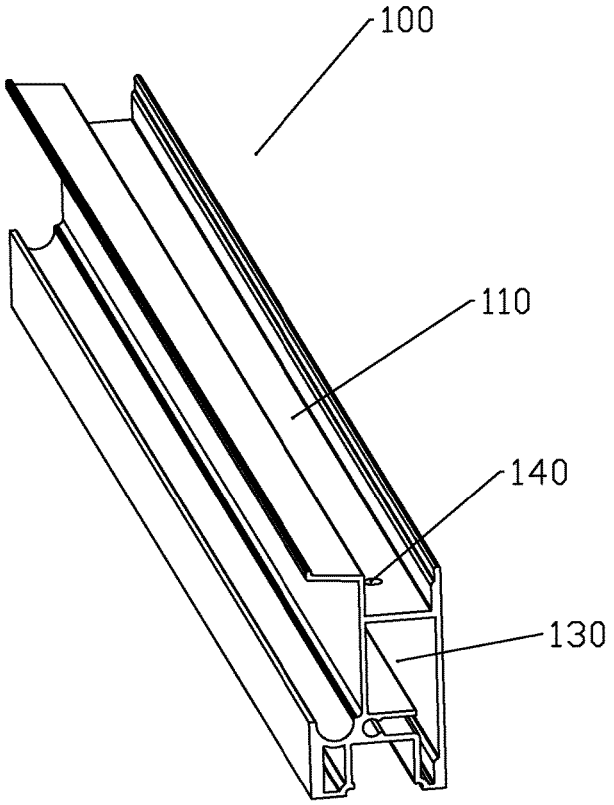
FIG. 4 is an enlarged structural view illustrating a track in the shower door frame embodiment of the present invention.

Referring to FIG. 4, the track 100 is formed by a plurality of metal plates, and the plurality of metal plates form a groove 110 opening upwardly and a cavity 130. The shape of the cavity 130 is identical to the cross-sectional shape of the fixing block 440, with dimensions being substantially the same. Moreover, the cavity 130 extends in a direction along the length of the track 100.

The fixing block 440 is fixed into the cavity 130. The positioning block 410 has a projection to prevent the positioning block 410 from entering the cavity 130. The fixing block 440 is provided therein with a first threaded hole 441, the track 100 is provided therein with a first mounting through-hole 140, and a first threaded fastener 150 is configured to pass through the first mounting through-hole 140 and screw into the first threaded hole 441. In the present embodiment, the first threaded fastener 150 is a screw.

Figure 5:
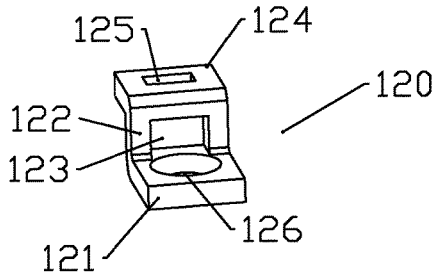
FIG. 5 is an enlarged structural view illustrating a fixing buckle in the shower door frame embodiment of the present invention.

The fixing buckle 120 is fixed into the groove 110. Referring to FIG. 5, the fixing buckle 120 comprises a bottom plate 121 fixed into the groove 110. The bottom plate 121 is provided thereon with a stopping plate 122, and the stopping plate 122 is provided therein with a stopping hole 123. A top plate 124 is arranged on a side at a top end of the stopping plate 122 away from the side frame 200, and the top plate 124 is provided therein with a top hole 125. The bottom plate 121 is provided therein with a second mounting through-hole 126, and the first threaded fastener 150 is configured to pass through the second mounting through-hole 126 and the first mounting through-hole 140 and screw into the first threaded hole 441. When an additional tool is configured to extend into the top hole 125 and apply a force therein, the tensioning part 520 may be separated from the stopping hole 123. For example, when a tool is configured to extend into the hole 125, the top plate 124 is pulled by an external force, which drives the stopping plate 122 to rotate along the joint of the stopping plate 122 and the bottom plate 121 so as to expand the distance between the stopping hole 123 and the side frame 200, thereby separating the tensioning part 520 from the stopping hole 123, and achieving the disassembly of the shower door frame.

Referring to FIG. 11, the tensioning part 520 comprises a hinged block 524 and an extension block 525 connected with the hinged block 524, a locking block 521 is arranged in the middle of the extension block 525, and a stopping shoulder 523 is arranged at the tail end of the extension block 525, wherein the stopping shoulder 523 is configured to extend into the stopping hole 123 to prevent the tensioning part 520 from rotating backwards. A locking groove 522 is formed between the hinged block 524 and the locking block 521. The hinged block 524 is provided therein with a pin hole.

Figure 8:
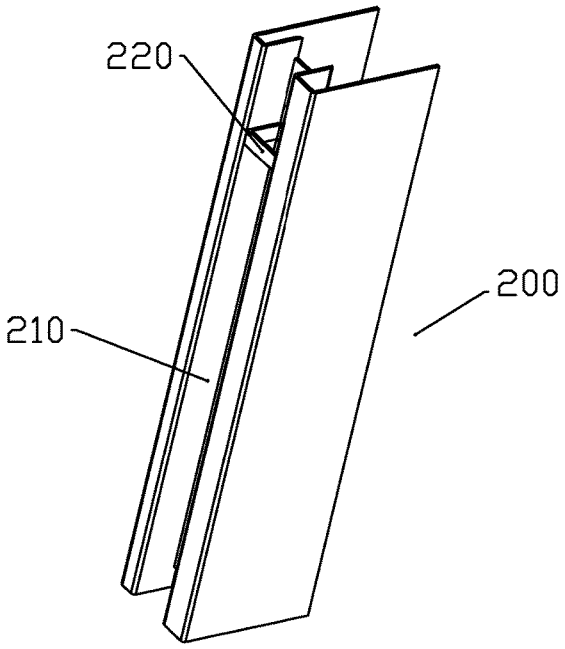
FIG. 8 is an enlarged structural view illustrating a side frame in the shower door frame embodiment of the present invention.
Figure 9:
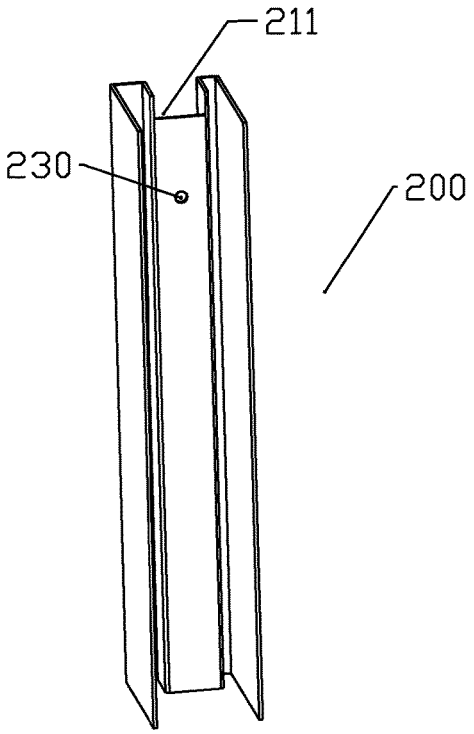
FIG. 9 is an enlarged structural diagram illustrating, from another viewing angle, the side frame in the shower door frame embodiment of the present invention.
Figure 10:
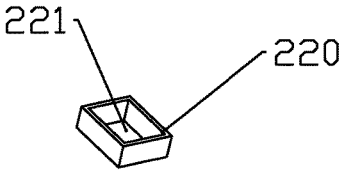
FIG. 10 is an enlarged structural view illustrating an inserting block in the shower door frame embodiment of the present invention.

Referring to FIGS. 8 and 9, the side frame 200 is also formed by a plurality of metal plates, which form a positioning groove 210 extending in a direction along the length of the side frame 200. The positioning groove 210 is provided therein with an inserting block 220, and referring to FIG. 10, the inserting block 220 is provided therein with an inserting hole 221. The positioning block 410 is embedded into the positioning groove 210, thus preventing the side frame 200 from rotating relative to the fixing part 400. A plug portion 430 is arranged at the bottom end of the positioning block 410, wherein the plug portion 430 is configured to extend into the inserting hole 221 and trapped therein, thus further preventing the side frame 200 from moving. The plug portion 430 is in the shape of a cuboid. Certainly, in practical use, the plug portion 430 may be designed to be in the shapes of a cylinder, an elliptic cylinder, etc. When the positioning groove 210 is made of stainless steel, the inserting block 220 may be welded into the positioning groove 210. Alternatively, the inserting block 220 may be connected with the positioning groove 210 via a third threaded fastener.

The fixed glass plate 310 is fixed into the positioning groove 210. The positioning groove 210 may also be provided therein with waterproof seals, shower door positioning elements, etc.

The base 510 is fixed on the outer side of the positioning groove 210. Referring to FIGS. 12-15, the base 510 has a seat plate 512, and two sides of the seat plate 512 are provided with side plates 513 perpendicular to the seat plate 512. Both the seat plate 512 and the side plates 513 are wrapped on the outer side of the positioning groove 210. The seat plate 512 is provided thereon with a hinged groove 511, and two sides of the hinged groove 511 are provided with pin holes. A pin 530 is configured to pass through the pin holes for the hinge of the hinged groove 511 with the hinged block 524.

An opening 211 is arranged at a location on the positioning groove 210 corresponding to the hinged groove 511. The tensioning part 520 is configured to pass through the opening 211 to be buckled with the retaining block 420.

The side frame 200 is provided with at least a third mounting through-hole 230, the third mounting through-hole 230 is located below the opening 211, and the second threaded fastener is configured to pass through the third mounting through-hole 230 to be connected with the base 510. In the present embodiment, the second threaded fastener is a screw.

Referring to FIGS. 3 and 17, when the shower door frame is assembled, the fixing block 440 of the fixing part 400 is first installed into the cavity 130 at the end portion of the track 100, and then, the fixing buckle 120, the track 100 and the fixing part 400 are coupled and fixed using the first threaded fastener 150.

Moreover, the fixing base 510 is installed onto the side frame 200, and then, coupling with the tensioning part 520 is achieved using the pin 530.

Thereafter, the track 100 is moved to make the plug portion 430 of the fixing part 400 extend into the inserting hole 221 provided in the side frame 200. At this time, the positioning block 410 of the fixing part 400 is installed into the positioning groove 210 of the side frame 200.

Finally, with reference to FIGS. 16 and 17, when the extension block 525 of the tensioning part 520 is operated to drive the tensioning part 520 to rotate, the locking groove 522 of the tensioning part 520 contacts with the retaining element 420 of the fixing part 400, and the stopping shoulder 523 of the tensioning part 520 extends into the stopping hole 123 of the fixing buckle 120, such that the tensioning part 520 is fixed onto the track 100, thus preventing the tensioning part 520 from rotating backwards.

Eventually, it should be noted that what have been described above are merely preferred embodiments of the present invention, which are not intended to limit the present invention. For those skilled in the art, various changes and modifications may be configured to the present invention, and all the modifications, equivalents, improvements and the like that are made without departing from the spirit and principle of the present invention shall be covered by the scope of protection of the present invention.

INDUSTRIAL APPLICABILITY

The shower door provided by the present invention is installed in a bathroom, and acts as an important constituent part of a shower room. The shower room may be an integral one having a floor portion, or it may be enclosed by shower doors and three walls by installing shower doors between two opposite walls. The shower door of the present invention may either be the one comprising only the upper track, or the one comprising both the upper track and the lower track. In the case that the shower door only comprises the upper track, coupling assemblies are required to be arranged respectively at the locations of the two side frames adjacent the upper track, and each of the coupling assemblies is composed of a fixing part and a locking assembly. In the case that the shower door comprises both the upper track and the lower track, it is required to be provided with four coupling assemblies arranged respectively at the upper and lower ends of the two side frames.

The shower door frame and the shower door of the present invention are suitable for use in the occasion in which field assembly needs to be conducted in a customer's bathroom. When the products of the present invention are applied, the assembly operation of the shower door is simple, and no screws are required to fix the side frame and the track. Therefore, it will take a little time for assembly operation of the shower door, and require relatively low physical demands on installers, so as to achieve the rapid and simple installation of the shower door.

The invention claimed is:

1. A shower door frame, comprising a track extending in a horizontal direction and a side frame arranged perpendicularly to the track;

wherein a fixing part is fixed at a tail end of the track, a positioning block is arranged on an outer side of the fixing part, a retaining block is arranged at a top end of the positioning block, and the positioning block is embedded into the side frame;

wherein a locking assembly is arranged on the side frame, the locking assembly comprises a base fixed on the side frame and a tensioning part hinged with the base, the tensioning part is provided with a locking groove, and the locking groove is buckled with the retaining block;

wherein the track is provided thereon with a groove, and a fixing buckle is fixed into the groove;

wherein a stopping shoulder is arranged at a tail end of the tensioning part, and the stopping shoulder extends into the fixing buckle; and wherein the tensioning part comprises a hinged block and an extension block connected with the hinged block, a locking block is arranged in the middle of the extension block, and the stopping shoulder is arranged at a tail end of the extension block; the locking groove is formed between the hinged block and the locking block.

2. The shower door frame according to claim 1, wherein the fixing buckle comprises a bottom plate fixed into the groove; the bottom plate is provided thereon with a stopping plate, the stopping plate is provided therein with a stopping hole, and the stopping shoulder extends into the stopping hole; a top plate is arranged at a top end of the stopping plate on a side away from the side frame, and the top plate is provided therein with a top hole.

3. The shower door frame according to claim 1, wherein the side frame is provided with a positioning groove extending in a direction along a length of the side frame, the positioning groove is provided therein with an inserting block, and an inserting hole is arranged in the middle of the inserting block; and wherein the positioning block is embedded into the positioning groove; a plug portion is arranged at a bottom end of the positioning block, and the plug portion passes through the inserting hole.

4. The shower door frame according to claim 3, wherein the base is fixed on an outer side of the positioning groove, and the base is provided with a hinged groove, and the hinged groove is hinged with the tensioning part via a pin; and wherein an opening is arranged at a location on the positioning groove corresponding to the hinged groove; and the tensioning part passes through the opening.

5. The shower door frame according to claim 1, wherein the fixing part comprises a fixing block; the track comprises a cavity having the same cross-sectional shape as the fixing block; and the fixing block is fixed into the cavity.

6. The shower door frame according to claim 5, wherein the fixing block is provided therein with a first threaded hole, the track is provided therein with a first mounting through-hole, and a first threaded fastener passes through the first mounting through-hole and screws into the first threaded hole.

7. The shower door frame according to claim 1, wherein the side frame is provided therein with at least a third mounting through-hole, and a second threaded fastener passes through the third mounting through-hole to connect with the base.

8. A shower door, comprising a track extending in a horizontal direction and a side frame arranged perpendicularly to the track, and a door plate is equipped in the side frame;

wherein a fixing part is fixed at a tail end of the track, a positioning block is arranged on an outer side of the fixing part, a retaining block is arranged at a top end of the positioning block, and the positioning block is embedded into the side frame;

wherein a locking assembly is arranged on the side frame, the locking assembly comprises a base fixed on the side frame and a tensioning part hinged with the base, the tensioning part is provided with a locking groove, and the locking groove is buckled with the retaining block;

wherein the track is provided thereon with a groove, and a fixing buckle is fixed into the groove;

wherein a stopping shoulder is arranged at a tail end of the tensioning part, and the stopping shoulder extends into the fixing buckle; and wherein the tensioning part comprises a hinged block and an extension block connected with the hinged block, a locking block is arranged in the middle of the extension block, and the stopping shoulder is arranged at a tail end of the extension block; and the locking groove is formed between the hinged block and the locking block.

9. The shower door according to claim 8, wherein the fixing buckle comprises a bottom plate fixed into the groove; the bottom plate is provided thereon with a stopping plate, the stopping plate is provided therein with a stopping hole, and the stopping shoulder extends into the stopping hole; a top plate is arranged at a top end of the stopping plate on a side away from the side frame, and the top plate is provided therein with a top hole.

10. The shower door according to claim 8, wherein the side frame is provided with a positioning groove extending in a direction along a length of the side frame, the positioning groove is provided therein with an inserting block, and an inserting hole is arranged in the middle of the inserting block; and wherein the positioning block is embedded into the positioning groove; a plug portion is arranged at a bottom end of the positioning block, and the plug portion passes through the inserting hole.

11. The shower door according to claim 10, wherein the base is fixed on an outer side of the positioning groove, and the base is provided thereon with a hinged groove, and the hinged groove is hinged with the tensioning part via a pin; and wherein an opening is arranged at a location on the positioning groove corresponding to the hinged groove; and the tensioning part passes through the opening.

12. The shower door according to claim 8, wherein the fixing part comprises a fixing block; the track comprises a cavity having the same cross-sectional shape as the fixing block; and the fixing block is fixed into the cavity.

13. The shower door according to claim 12, wherein the fixing block is provided therein with a first threaded hole, the track is provided therein with a first mounting through-hole, and a first threaded fastener passes through the first mounting through-hole and screws into the first threaded hole.

14. The shower door according to claim 8, wherein the side frame is provided therein with at least a third mounting through-hole, and a second threaded fastener passes through the third mounting through-hole to connect with the base.

* * * * *